United States Patent [19]

Morefield

[11] 4,349,038

[45] Sep. 14, 1982

[54] HAIR TREATMENT DEVICE

[76] Inventor: Joe Morefield, 400 Reynolds St., Springhill, La. 71075

[21] Appl. No.: 246,603

[22] Filed: Mar. 23, 1981

[51] Int. Cl.[3] ..... A45D 2/00

[52] U.S. Cl. ..... 132/40; 132/42 A; 132/39

[58] Field of Search ..... 132/40, 41, 42, 39

[56] References Cited

U.S. PATENT DOCUMENTS 4,201,236 11/1980 Morefield ..... 132/40

FOREIGN PATENT DOCUMENTS 1249042 11/1960 France ..... 132/42 R

*Primary Examiner*—G. E. McNeill

*Attorney, Agent, or Firm*—John M. Harrison

[57] ABSTRACT

A hair treatment device characterized by a generally cylindrically shaped, hollow tension roller having a plurality of slots provided in spaced relationship along the longitudinal axis in the outside wall of the tension roller, and a securing means cooperating with the tension roller for securing the tension roller on the head and tensioning strands of hair wound on the roller for chemical treatment. In a preferred embodiment of the invention the securing means is characterized by a tension pin provided with a cooperating elastic cord and a hook attached to the free end of the cord for adjustably applying tension on a segment of hair wound on the roller for the purpose of treating the hair strands and setting the hair.

10 Claims, 10 Drawing Figures

HAIR TREATMENT DEVICE

BACKGROUND OF THE INVENTION

1. Field of the Invention

This invention relates to hair treatment, and more particularly, to a hair treatment device for use primarily in the process of setting hair and straightening naturally curly hair by applying tension to the hair shaft and applying a selected hair setting or relaxing solution. One of the problems associated with curly hair is the tendency of the hair ends to become "stringy" and difficult to manage. The hair shafts are subjected to tension, which causes the curls, and can be relaxed only by application of certain chemicals to eliminate, or at least minimize, the wave pattern in the hair. Typically, these chemicals are applied after the hair is parted, and the solution is allowed to remain on the hair for a specified period of time to relax the hair shafts and remove the wave. This technique has long been used to relax the natural wave in hair and to change the wave pattern to more manageable proportions. The hair treatment device of this invention includes a hollow tension roller of generally cylindrical configuration and provided with a plurality of spaced slots extending along the outside surface thereof, and along the longitudinal axis of the roller for engagement by a hook and stretch cord mechanism designed to apply tension to strands or tresses of hair which are wound on the roller. The hair strands so positioned on the roller can be subjected to a selected amount of tension by simply rotating the tension roller and selecting a suitable slot for engagement of the tension hook. A tension pin is provided in cooperation with the elastic band and tension hook in order to stabilize the roller in the hair and provide the desired degree of tension on the wound hair strands. The tension roller of this invention may be quickly and easily positioned in the hair, and the hair relaxing solutions of desired composition may then be applied in order to accomplish the desired purpose. The tension roller can also be used to "set" hair and create curly hair in permanent waves by using the tensioning means, as hereinafter described.

2. Description of the Prior Art

Many devices for curling and treating hair are known in the prior art, and typical of such devices is the hair curling device disclosed in U.S. Pat. No. 3,105,503 to Albert Safianoff, which consists of a mandrel and a cooperating sleeve designed to hold a tress of hair in wound configuration on the mandrel. The device is designed to form curls in the hair as the individually wound tresses are caused to assume a curled configuration from winding on the mandrel. Another hair curling device is disclosed in U.S. Pat. No. 2,423,252 to O. R. Nemeth, which device is used for both dressing and drying hair. The Nemeth apparatus includes a hollow cylindrical body fitted with a spaced disc and hole provided in the body to permit air to be blown through the hollow interior of the body and out of the holes. Hair tresses are wound around the cylindrical body between the discs, treated as desired, and then dried by application of air, for example, by means of a hair dryer. The tresses are then secured in place by elastic bands stretched from one end of the device to the other.

While the references described above are used primarily to render hair curly by the techniques described therein, the device of the instant invention is designed to both curl hair and to straighten naturally curly hair by applying tension to the hair shafts and subsequently applying a hair setting or relaxing solution of selected concentration to the hair. There exists today a need in the hair treatment field for, and it is an object of this invention to provide, a hair treatment device for both setting hair and straightening naturally curly hair, which device is small, light in weight, easy to manipulate, and to anchor in the hair, and is capable of receiving strands, tufts, or tresses of hair in isolated fashion for efficient treatment.

Another object of this invention is to provide a hair treatment device which applies tension to the hair shaft preparatory to application of a hair setting or relaxing solution, and eliminates the necessity for combing and smoothing the hair in isolated segments or sections prior to application of the hair treatment solution.

A still further object of this invention is to provide a new and improved hair treatment device which, in a preferred embodiment, is characterized by a generally cylindrically shaped, hollow and longitudinally-slotted tension roller which may be optionally fitted with a divider in order to permit separate treatment of different segments of the hair wound on the roller, and a cooperating securing means for stabilizing the tension roller and hair tufts or tresses wound threon in the hair, and applying tension to the hair shaft preparatory to application of a hair relaxing solution and/or a hair setting solution to create a smooth, wavy hair shaft which is easily managed.

Yet another object of this invention is to provide a hair treatment device which minimizes contact between the hair treatment solution and the scalp, and which includes a generally cylindrical shaped, hollow tension roller having a plurality of longitudinally-oriented grooves or slots provided in spaced relationship around the circumference thereof, and a tension means for selectively engaging the grooves and applying a desired degree of tension on the hair shafts wound on the roller to facilitate application of hair relaxing and/or hair setting solution to create a desired hair styling.

Still another object of this invention is to provide a new and improved hair treatment device which includes a generally cylindrically shaped, hollow tension roller having a plurality of slots provided in spaced relationship in the outer surface thereof, and a removable divider provided near the center of the tension roller in essentially corkscrew configuration to permit a hair tuft or tress to be wound on the roller and secured thereon in tension by application of a tension means cooperating with a selected one of the slots, and appropriate treatment of the hair tuft or strand, according to the desires of the user.

A still further object of the invention is to provide a cylindrical, hollow tension roller which, in a preferred embodiment of the invention is characterized by multiple, longitudinally-oriented slots or grooves in the outer peripheral surface thereof, and a cooperating tension means which is characterized by a tension pin fitted with an elastic cord and a tension hook at the opposite end of the cord for rolling hair strands on the tension roller, engagement of the tension hook with a selected one of the grooves or slots to provide a selected degree of tension on the hair strands, and treatment of the hair with setting or relaxing solutions to create a hair style of desired proportions and appearance.

SUMMARY OF THE INVENTION

These and other objects of the invention are provided in a new and improved hair treatment device which includes a generaly cylindrically-shaped, hollow tension roller having a plurality of slots provided in longitudinal relationship in the outer peripheral surface of the roller, and a tension means which is characterized by an elongated tension pin having an elastic band attached to one end thereof, and a tension hook carried by the opposite end of the elastic band for engaging selected ones of the slots and applying tension to a tuft or strands of hair wound on the roller in order to facilitate appropriate treatment of the hair. In a preferred embodiment of the invention the tension roller is fitted with a removable divider near the center thereof and provided in corkscrew fashion around a portion of the circumference of the roller to facilitate dividing the strands of hair wound on the roller in two portions for separate treatment.

BRIEF DESCRIPTION OF THE DRAWING

The invention will be better understood by reference to the accompanying drawing, wherein.

DESCRIPTION OF THE PREFERRED EMBODIMENTS

Figure 1:
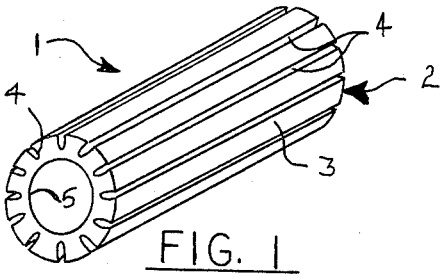
FIG. 1 of the drawing is a perspective view of a preferred embodiment of the tension roller of this invention.
Figure 2:
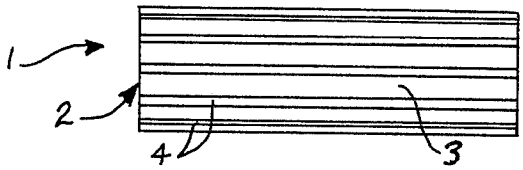
FIG. 2 is a front elevation of the tension roller illustrated in FIG. 1.
Figure 3:
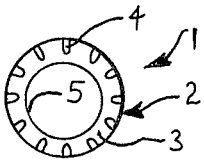
FIG. 3 is a side elevation of the tension roller illustrated in FIGS. 1 and 2.

Referring now to FIGS. 1–3 of the drawing, the hair treatment device of this invention is generally illustrated by reference numeral 1, and includes a generally cylindrically-shaped tension roller 2, having a rounded roller body 3, and a plurality of slots 4, provided in longitudinal, parallel relationship in roller body 3, as illustrated. In a preferred embodiment of the invention roller body 3 is characterized by a hollow interior 5, the diameter of roller body 3 is abou 0.563 inches, and the roller body is provided with eight slots 4, each spaced at an angle of about 45 degrees with respect to each other. In this embodiment of the invention tension roller 2 is about two and one-half inches in length and is preferably formed of plastic. In yet another preferred embodiment of the invention the tension roller is two and one-half inches long, the diameter of roller body 3 is about 0.813 inches, and twelve slots 4 are provided in roller body 3, each spaced at an angle of about 30 degrees with respect to each other. In still another preferred embodiment, tension roller 2 is again about two and one-half inches long, fourteen slots 4 are provided in roller body 3, and these slots are positioned at an angle of about 25 degrees with respect to each other. In a still further preferred embodiment of the invention tension roller 2 is two and one-half inches long, sixteen slots 4 are provided in roller body 3, and these slots are positioned at an angle of about 22 degrees with respect to each other.

Figure 6:
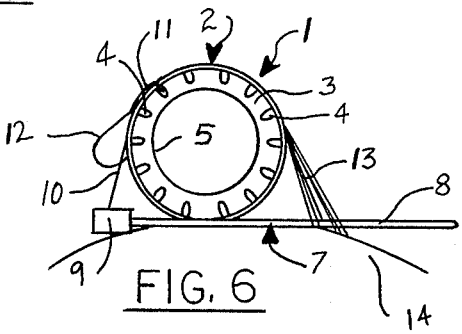
FIG. 6 is a side elevation of one embodiment of the tension roller in functional position with strands of hair wound thereon and placed in tension by application of the tension pin, elastic band and tension hook illustrated in FIG. 5.
Figure 4:
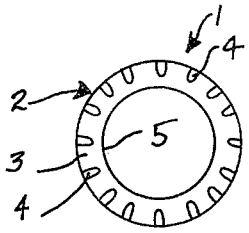
FIG. 4 is a side elevation of a slightly larger tension roller of the same design as that illustrated in FIGS. 1–3.
Figure 5:
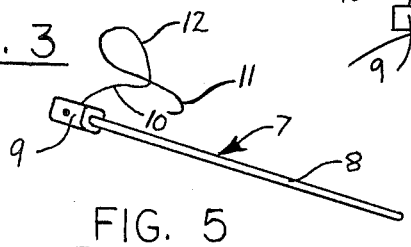
FIG. 5 is a perspective view of a preferred tension pin and cooperating elastic band and tension hook for use with the tension roller of this invention.
Figure 7:
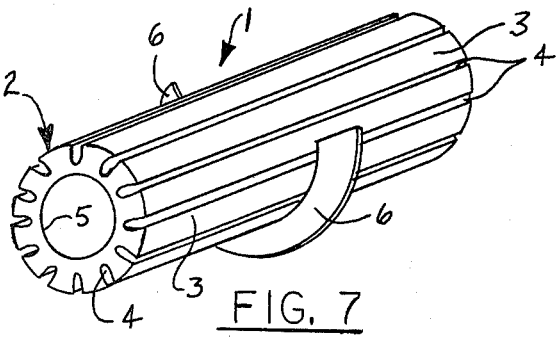
FIG. 7 is a perspective view of another preferred embodiment of the invention wherein the tension roller is fitted with a divider.
Figure 8:
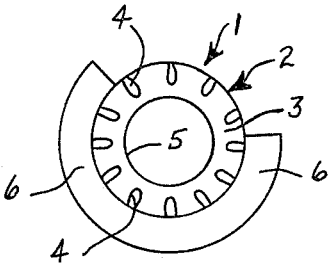
FIG. 8 is a side elevation of the tension roller illustrated in FIG. 7.

Referring now to FIGS. 5 and 6 of the drawing, the hair treatment device 1 is utilized to tension hair strands or tresses 13 by rolling the hair strands or tresses on a tension roller 2 in conventional fashion as illustrated, and slipping a tension pin 7, which is characterized by a tension grip 9 and a cooperating tension pin shaft 8, beneath roller body 3, as illustrated in FIG. 6 to secure tension roller 2 next to the scalp 14. A stretchable tension cord 10, having a shaped tension hook 11 and a tension hook grip 12 attached to one end of tension cord 10 is then stretched from its opposite end connection at pin grip 9, upwardly to engage a selected one of the slots 4 in roller body 3, which operates to apply the desired degree of tension on hair strands 13. When the selected degree of tension is reached in hair strands 13, tension hook 11 is engaged in one of slots 4 as illustrated, and the tension roller 2 is in functional position, with the hair strands 13 ready for the appropriate chemical treatment.

Figure 9:
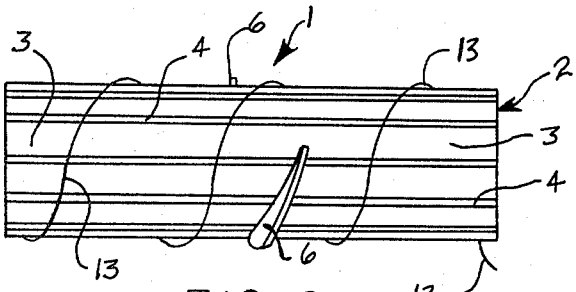
FIG. 9 is a front elevation of the tension roller illustrated in FIGS. 7 and 8.
Figure 10:
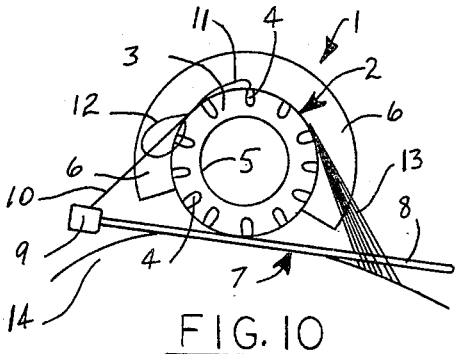
FIG. 10 is a side elevation of the tension roller illustrated in FIGS. 7–9, with hair strands wound thereon and placed in tension by application of the tension pin, elastic band and tension hook illustrated in FIG. 5.

Referring now to FIGS. 7–10, in a most preferred embodiment of the invention the tension roller 2 is provided with a divider 6, which is attached to roller body 3 near the center thereof in corkscrew fashion, and extends around a portion of the periphery of roller body 3 in essentially transverse relationship to slots 4, as illustrated. The purpose of divider 6 is to provide a means for wrapping a tress of hair strands 13 around the circumference of roller body 3, as illustrated in FIG. 9, to provide a means for dividing the hair strands 13, in order to permit separate treatment of the strands. Accordingly, as illustrated in FIGS. 9 and 10, the hair strands 13 can be treated by one solution on the left hand side of divider 6, and another solution on the right hand side of the divider, as shown in FIG. 9, when the hair strands 13 are wound on roller body 3 in the manner indicated in FIG. 10. As further illustrated in FIG. 10, the hair strands 13 are wound on roller body 3 in the same manner as illustrated in FIG. 6, with approximately one-half of the strands on one side of the divider 6 and the other half on the other side of the divider. The hair strands 13 are held in tension by means of tension pin 7 and the cooperating tension cord 10 and tension hook 11, as heretofore described. Accordingly, under circumstances where it is desired to use separate setting or relaxing solutions on common tresses or curls of hair, the roller body 3 having the divider 6 as illustrated in FIGS. 7–10 can be used in the manner described with good results.

While it will be appreciated by those skilled in the art that substantially any material can be used to manufacture the tension roller of this invention, in a preferred embodiment of the invention roller body 3 is shaped from plastic materials. In the embodiment where divider 6 is utilized, each dividers 6 can also be formed of plastic by extrusion, molding or other techniques known to those skilled in the art. It will also be appreciated that divider 6 can be removably fit to roller body 3, and slidably adjusted on the roller body by spring tension on the divider. Furthermore, while it is preferred to manufacture tension roller 2 with a hollow interior 5, it will be further appreciated that the roller may be solid, in the event tht manufacturing techniques are more easily accomplished utilizing bar stock rather than hollow, round stock.

Having described my invention with the particularity set forth above, what is claimed is:

1. A hair treatment device for treating hair rolled thereon, comprising (a) A tension roller having a plurality of longitudinally-shaped slots in the outer surface thereof; and (b) Tension means engaging one of said slots and positioned beneath said tension roller to apply tension on said hair.

2. The hair treatment device of claim 1 wherein said tension means further comprises a pin positioned beneath said tension roller; an elastic band having one end attached to said pin; and a hook attached to the free end of said elastic band for engagement with said one of said slots.

3. The hair treatment device of claim 1 wherein said tension roller is round and hollow, and said slots are substantially equally spaced in the outer surface of said roller.

4. The hair treatment device of claim 1 wherein:

(a) said tension means further comprises a pin positioned beneath said tension roller; an elastic band having one end attached to said pin; and a hook attached to the free end of said elastic band for engagement with said one of said slots; and (b) said tension roller is round and hollow, and said slots are substantially equally spaced in the outer surface of said roller.

5. The hair treatment device of claim 1 further comprising a divider secured in essentially perpendicular, transverse relationship to said tension roller and extending around at least one-half of the circumference of said tension roller in non-planar relationship.

6. The hair treatment device of claim 1 further comprising a divider secured in essentially perpendicular, transverse relationship to said tension roller and extending around at least one-half of the circumference of said tension roller in non-planar relationship; and wherein:

(a) said tension means further comprises a pin positioned beneath said tension roller; and elastic band having one end attached to said pin; and a hook attached to the free end of said elastic band for engagement with said one of said slots; and (b) said tension roller is round and hollow, and said slots are substantially equally spaced in the outer surface of said roller.

7. A hair treatment device for rolling and treating strands of hair comprising:

(a) A generally cylindrically-shaped tension roller having a plurality of grooves provided in spaced relationship in the outer surface, and parallel to the longitudinal axes thereof;

(b) A pin for insertion in said hair beneath said tension roller;

(c) An elastic band having one end secured to said pins; and (d) A tension hook secured to the opposite end of said elastic band and engaging one of said grooves in said tension roller for applying tension to said strands of hair.

8. The hair treatment device of claim 7 further comprising a divider secured in essentially perpendicular, transverse relationship to said tension roller and extending around at least one-half of the circumference of said tension roller in non-planar relationship.

9. The hair treatment device of claim 7 wherein said plurality of grooves is from about 8 grooves to about 16 grooves.

10. The hair treatment device of claim 9 further comprising a grip provided in said tension hook for inserting said tension hook in said grooves.

* * * * *